US008408407B2

(12) United States Patent
Nibouar et al.

(10) Patent No.: US 8,408,407 B2
(45) Date of Patent: Apr. 2, 2013

(54) KNUCKLE FORMED THROUGH THE USE OF IMPROVED EXTERNAL AND INTERNAL SAND CORES AND METHOD OF MANUFACTURE

(75) Inventors: F. Andrew Nibouar, Chicago, IL (US); Douglas Smith, Elridge, IA (US); Jerry R. Smerecky, Roselle, IL (US)

(73) Assignee: Bedloe Industries LLC, Wilmington, DE (US)

( * ) Notice: Subject to any disclaimer, the term of this patent is extended or adjusted under 35 U.S.C. 154(b) by 59 days.

(21) Appl. No.: 12/979,967

(22) Filed: Dec. 28, 2010

(65) Prior Publication Data

US 2012/0000877 A1 Jan. 5, 2012

Related U.S. Application Data

(60) Provisional application No. 61/291,584, filed on Dec. 31, 2009.

(51) Int. Cl.
*B61G 3/00* (2006.01)

(52) U.S. Cl. ..... 213/155; 213/118

(58) Field of Classification Search ..... 213/75 R, 213/155; 164/137, 340, 369, 370
See application file for complete search history.

(56) References Cited

U.S. PATENT DOCUMENTS

| | | | | |
|---|---|---|---|---|
| 2,688,412 | A * | 9/1954 | Kulieke | 213/155 |
| 2,997,755 | A * | 8/1961 | Olson | 164/232 |
| 4,143,701 | A * | 3/1979 | Oshinsky et al. | 164/368 |
| 5,479,981 | A * | 1/1996 | Kim | 164/16 |
| 6,588,490 | B2 * | 7/2003 | Rommel et al. | 164/369 |
| 7,302,994 | B2 * | 12/2007 | Mautino et al. | 164/137 |
| 8,196,762 | B2 * | 6/2012 | Smerecky | 213/155 |
| 8,201,613 | B2 * | 6/2012 | Marchese et al. | 164/137 |
| 2002/0007931 | A1 * | 1/2002 | Crafton et al. | 164/127 |

(Continued)

FOREIGN PATENT DOCUMENTS

| | | | |
|---|---|---|---|
| CN | 201 102 057 | Y | 8/2008 |
| CN | 101402131 | A | 4/2009 |

(Continued)

OTHER PUBLICATIONS

International Search Report and Written Opinion for International Patent Application No. PCT/US2010/062574, dated May 30, 2011, 13 pages.

(Continued)

*Primary Examiner* — Jason C Smith
(74) *Attorney, Agent, or Firm* — Nathan O. Greene; Brinks Hofer Gilson & Lione

(57) ABSTRACT

A method for manufacturing a railcar coupler knuckle, said method includes providing a cope mold portion and a drag mold portion. The cope and drag mold portions have internal walls that define at least in part perimeter boundaries of a coupler knuckle mold cavity. At least one chill core is positioned within one of the cope mold portion and the drag mold portion. The cope and drag mold portions are closed, with the at least one core therebetween, and the closed cope and drag mold portions and the chill core define a parting line. The mold cavity is filled with a molten metal, which solidifies after filling to form a casting. The casting includes a pulling face portion defined by the chill core, and a central section of the pulling face portion does not contain the parting line and requires no finish grinding upon its formation.

30 Claims, 8 Drawing Sheets

U.S. PATENT DOCUMENTS

| | | | | |
|---|---|---|---|---|
| 2005/0184021 | A1* | 8/2005 | Mautino et al. | 213/118 |
| 2006/0113267 | A1* | 6/2006 | Mautino et al. | 213/118 |
| 2009/0289023 | A1* | 11/2009 | Marchese et al. | 213/155 |
| 2009/0289024 | A1* | 11/2009 | Nibouar et al. | 213/75 R |
| 2009/0294395 | A1* | 12/2009 | Smerecky | 213/155 |
| 2011/0068077 | A1* | 3/2011 | Smyth | 213/155 |
| 2011/0266242 | A1* | 11/2011 | Maxeiner et al. | 213/155 |
| 2012/0000877 | A1* | 1/2012 | Smith et al. | 213/155 |

FOREIGN PATENT DOCUMENTS

| | | | |
|---|---|---|---|
| GB | 743 098 | A | 1/1956 |
| GB | 2292899 | A | 3/1996 |
| GB | 2300611 | A | 11/1996 |
| JP | 2004 017099 | A | 1/2004 |
| JP | 2004 025210 | A | 1/2004 |
| WO | WO2009142748 | A1 | 11/2009 |
| WO | WO2009142750 | A1 | 11/2009 |
| WO | WO2009142757 | A1 | 11/2009 |
| WO | WO 2011/082348 | A1 | 7/2011 |

OTHER PUBLICATIONS

Invitation to Pay Additional Fees (Form PCT/ISA/206) and Annex to Form PCT/ISA/206 for International Application No. PCT/US2012/048002, dated Oct. 25, 2012, 9 pages.

International Search Report and Written Opinion for International Application No. PCT/US2012/037980, dated Aug. 14, 2012, 11 pages.

Steel Castings Handbook, Sixth Edition. Steel Founders' Society of America, ASM International, 1995, 4 pages.

* cited by examiner

KNUCKLE FORMED THROUGH THE USE OF IMPROVED EXTERNAL AND INTERNAL SAND CORES AND METHOD OF MANUFACTURE

RELATED APPLICATIONS

The present patent document claims the benefit of the filing date under 35 U.S.C. §119(e) of Provisional U.S. Patent Application Ser. No. 61/291,584, filed Dec. 31, 2009, which is hereby incorporated by reference.

BACKGROUND

1. Technical Field

The present embodiments relate generally to the field of railroad couplers, and more specifically, to the manufacture of an improved knuckle through the use of an improved sand core.

2. Related Art

Railcar couplers are disposed at each end of a railway car to enable joining one end of such railway car to an adjacently disposed end of another railway car. The engageable portion of each of these couplers is known in the railway art as a knuckle.

Typically, a knuckle is manufactured by a mold and several cores that are disposed within the mold. The mold shapes the outside of a casting. The cores are disposed to shape the inside or outside of a casting. Without the inside cores, the casting would be made of solid metal. The outside cores help shape the exterior of the casting. The inside cores commonly are referred to as a finger core in the front portion of the knuckle, a pivot pin core in the center of the knuckle, and a kidney core at the rear of a knuckle, and form the cavities in the knuckle upon casting.

During the casting process itself, the interrelationship of the mold and three cores (sometimes manufactured as one or two piece cores) disposed within the mold are critical to producing a satisfactory railway coupler knuckle. Many knuckles fail from internal and/or external inconsistencies in the metal throughout the thickness of the knuckle. If one or more cores move during the casting process, then some knuckle walls may end up thinner than others, resulting in offset loading and, in turn, resulting in an increased failure risk during use of the knuckle.

The external features of a coupler knuckle should meet railroad industry standards both because of initial acceptance of the knuckle and for its successful performance in service. One external feature that must be formed properly for successful knuckle performance in service is the pulling face contour. The pulling faces of mating couplers contact each other when freight cars are coupled together and transmit the forces pulling the train. The pulling forces within a train can be substantial. For this reason, railroad industry standards exist that specify the shape of the pulling face contour. Inconsistent or out of tolerance pulling face contours can result in poor coupling/uncoupling performance of the coupler or in detrimental load paths for the pulling load. One patent that discusses the importance of the proper performance of the pulling face is U.S. Pat. No. 7,337,826 entitled "Railway Car Coupler Knuckle Having Improved Bearing Surface." The '826 patent describes techniques for casting a knuckle coupler with an enhanced bearing surface. The '826 patent, however, is silent regarding as to addressing the imperfections that can form on the knuckle during casting.

Coupler knuckles are generally manufactured from cast steel or alloys. Typically, silica sand or silica sand derivatives known in the art are used to create the mold walls and the cores. Such sands, however, have several potential drawbacks, which can adversely affect the knuckle's surface finish or its ability to maintain required dimensional control, which in turn can lead to the premature failure of the knuckle and increase maintenance costs as a result of premature failure.

By way of example, when a molten metal is introduced into a mold during casting, it is prone to shrinking as it cools and solidifies. This is known as "shrinkage" or "micro-shrinkage" and occurs because most metals are less dense as a liquid than as a solid. Shrinkage may occur on the outside of the casting, the inside of the casting, or both. Shrinkage may lead to the knuckle to form shrinkage defects and even a void in certain portions of the knuckle. This could cause the coupler to prematurely wear or result in premature fatigue and/or failure.

One technique used to overcome micro-shrinkage is the inclusion of risers in the mold to feed the volumes of the casting that are prone to shrinkage with additional casting material as it cools. However, once the knuckle is cast, the risers must be removed, typically by surface grinding. This may cause damage to the knuckle's surface and cause the knuckle to prematurely fatigue and/or fail. Moreover, risers and/or large ingates, i.e., material that connects the risers to the casting, are limited in their ability to provide for a uniform thickness throughout the casting, maintain precise part profile, and lose their effectiveness in areas further away from the riser.

Another technique used to address micro-shrinkage issues is the addition of metal chills. These may be external chills, which may be placed along the mold walls at predetermined locations, or may be internal chills. Internal chills can be pieces of metal that are strategically placed inside the mold cavity and ultimately become part of the casting. Chills absorb and remove the heat from the poured metal in the location of the chill in order to promote solidification and limit the amount of shrinkage in the vicinity of the small area in which they are located. External chills, however, may leave scars or other defects on a casting's surface that requires the casting to undergo extra finishing operations such as grinding, which may adversely affect the knuckle's surface finish. External chills add additional cost, and due to their manual application can result in inconsistent quality. Sometimes personnel inadvertently neglect the installations of chills or place them in the incorrect location. Internal chills add cost because they must be made of the same material, or at least compatible, with the casting. Moreover, chills may not fuse properly with the casting, thus causing premature failure or again requiring the casting to undergo a further finishing and/or repair process. Moreover, chills must be clean and free of rust or other impurities so as not to inhibit the solidification process.

Another drawback associated with silica sand and its derivatives is their higher rate of thermal expansion during the casting process. This may cause the mold to develop buckles and ultimately crack, such that the molten metal will enter the crack and create a fin projecting from the casting surface (also known as a "vein"). It is preferred that these veins are removed, again typically through a grinding process, which again may result in fatigue failures, and correspondingly increases the finishing cost.

SUMMARY OF INVENTION

In a first embodiment, a method for manufacturing a railcar coupler knuckle includes providing a cope mold portion and a drag mold portion. The cope and drag mold portions have internal walls defining at least in part perimeter boundaries of a coupler knuckle mold cavity. At least one chill core is positioned within one of the cope mold portion and the drag mold portion. The cope and drag mold portions are closed with the chill core there between, and the closed cope and draft mold portions and the chill core define a parting line. The mold cavity is filled with a molten metal and solidifies to form a casting that includes a pulling face portion defined by the chill core. A central section of the pulling face portion does not contain the parting line and requires no finish grinding.

A railcar coupler assembly also is provided that includes a casting having a bearing surface formed at least in part by an external core positioned within a mold. A parting line is formed on at least a portion of the casting that is formed by the external core and the mold but is not formed on the bearing surface. The bearing surface requires no grinding upon its formation and the external core reduces micro-shrinkage in the area of the bearing surface.

A railcar coupler knuckle also is provided that has a pulling face portion. The pulling face portion defines a contour of the knuckle for interfacing with another coupler knuckle. A pulling face portion of the casting is defined at least in part by an external core disposed within a mold. The external core includes a chill core portion that defines a central portion of the pulling face portion such that the central portion does not include a parting line and requires no grinding upon its formation.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

Figure 1:
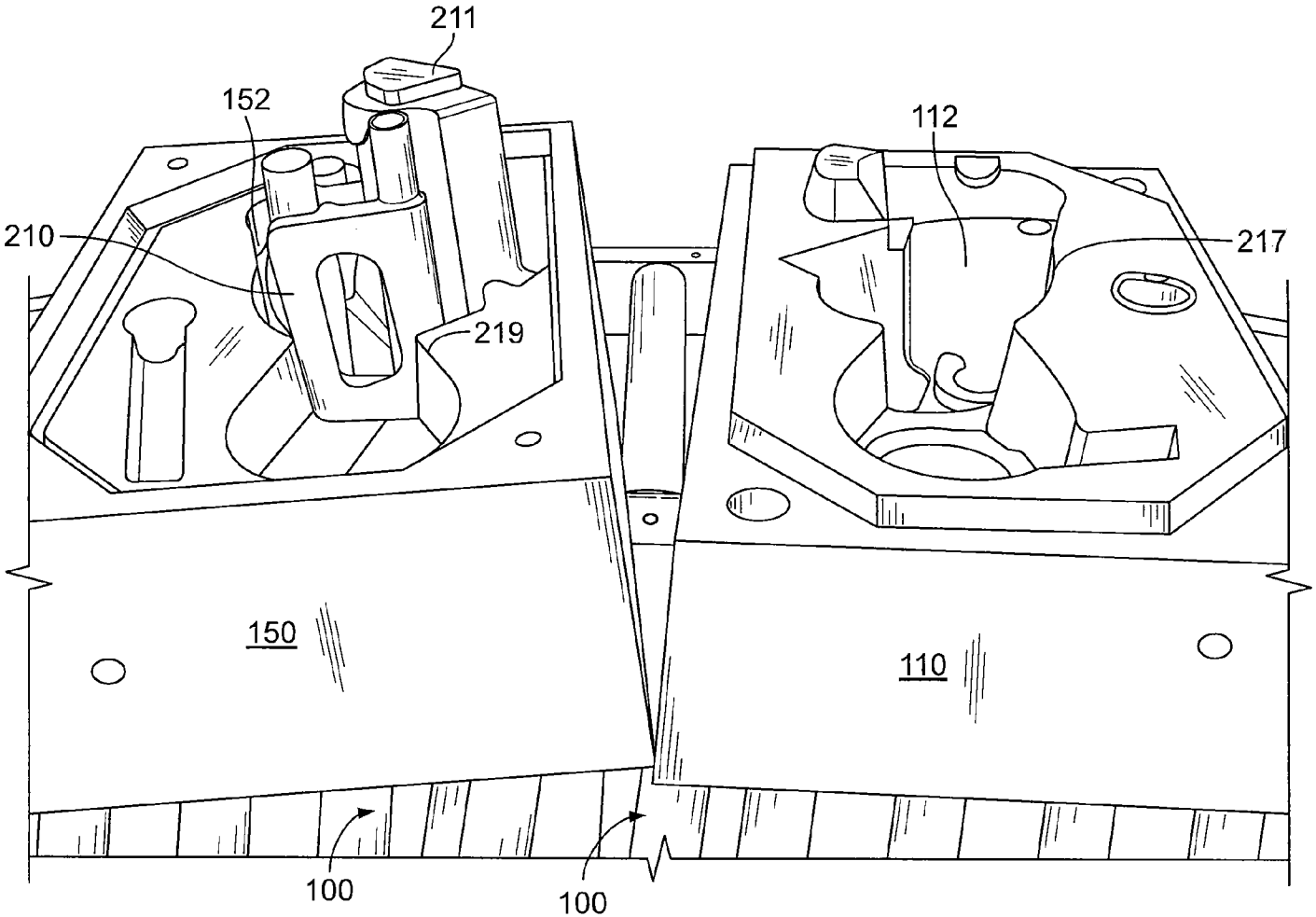
FIG. 1 is a view of cope and drag portions of a mold to cast a coupler knuckle, with internal and external cores disposed within the cavity of the drag mold portion.
Figure 2:
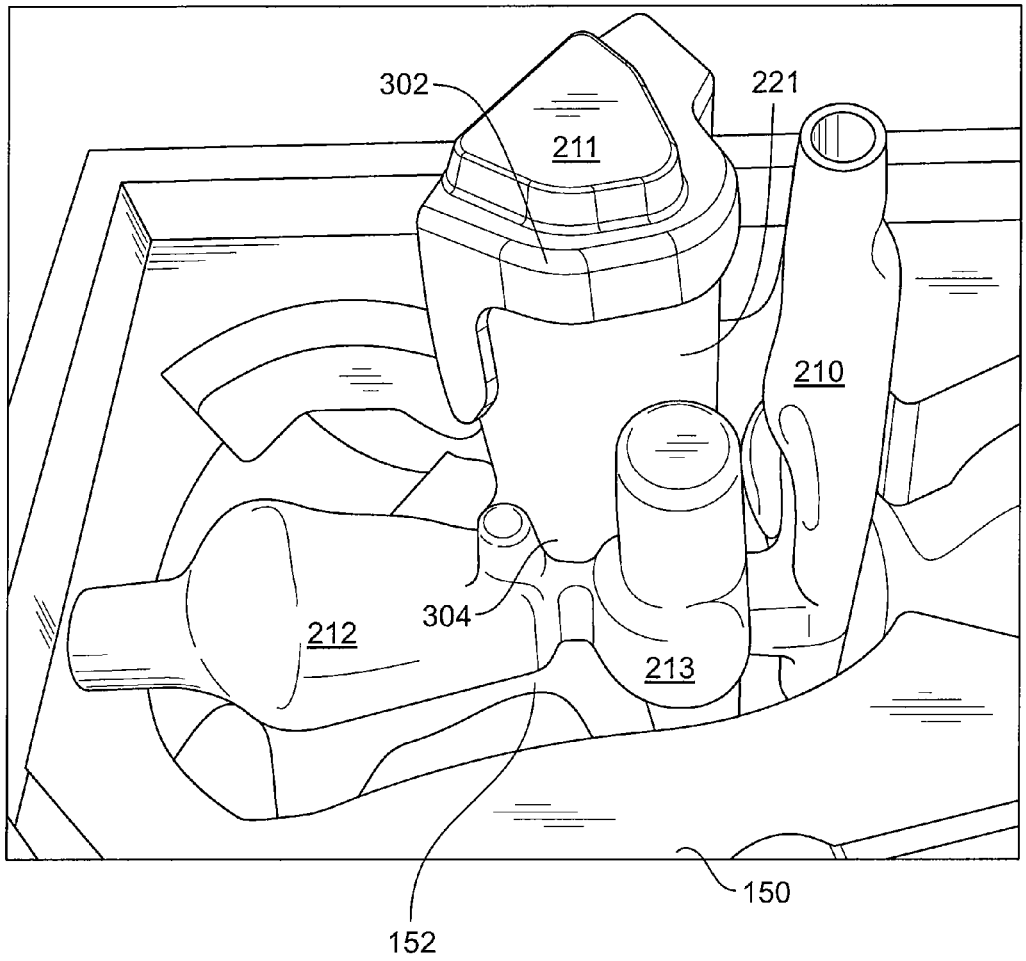
FIG. 2 is a top perspective view of the drag mold portion of FIG. 1, with internal and external cores disposed within the cavity.
Figure 3:
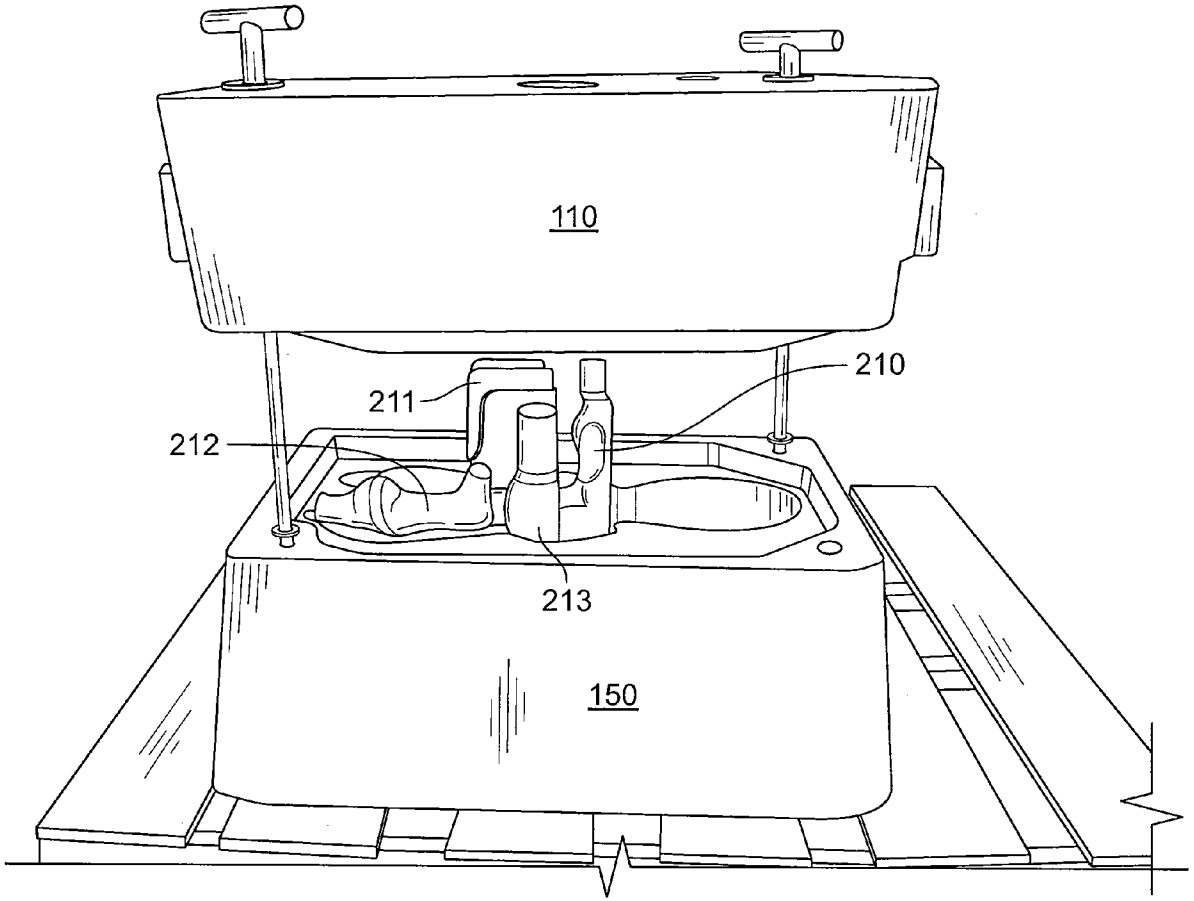
FIG. 3 is a side view of the drag mold portion of FIG. 2 showing the cope mold portion being lowered over the drag mold portion and the internal and external cores.

The disclosure herein describes improved cores to improve the strength, fatigue life, and operational performance of the coupler knuckle. Referring to FIGS. 1 and 2, a railroad coupler knuckle is made from a mold 100 that includes cope and drag sections 110, 150, respectively. The cope and drag sections each include cavities 112, 152, respectively, into which a molten metal or alloy is poured to cast the coupler knuckle. Disposed within the drag section cavity 152 is a plurality of cores. This exemplary embodiment includes a finger core 210, a pivot core 213, a kidney core 212, and a pulling face core 211. As explained further below and as shown in FIG. 3, once the cores are positioned within the drag section cavity 152, the cope section 110 is lowered onto the drag section 150, such that they also are at least partially disposed within the cope section cavity 112, in order to begin the process of forming the coupler knuckle. Note that in other embodiments the cores may be disposed within the cope section cavity such that the drag section is lowered onto the cope section to begin the process of forming the coupler knuckle.

The finger core 210, pivot core 213, and kidney core 212 are "internal" cores that help form interior cavities (i.e., the finger, pivot and kidney cavities) of the coupler knuckle. The pulling face core 211 is an "external" core that, along with the outer surfaces 217, 219 of the mold cavities 112, 152, respectively, forms the external surfaces of the coupler knuckle. While three internal cores are identified, they may be configured in a variety of ways. For example, the internal cores may be made as three separate cores, such that three separate parts must be joined to each other and then disposed within the mold prior to commencing with the casting process. However, it often is desirable to reduce the number of cores. An example of a casting made out of a reduced number of cores is disclosed in U.S. Pat. No. 7,302,994 entitled "Method and System for Manufacturing a Coupler Knuckle." The '994 provides that one or two internal cores may be used to define the finger, pivot and kidney cavities. Such a reduction results in less material being required overall to form the cores. Moreover, reducing the number of cores also reduces the potential for movement between the cores during the casting process, which can result in some knuckle walls being thinner than others. This, in turn, may reduce failures attributable to a non-uniformly cast knuckle. In addition, reduction of the number of cores or reduction in the overall size of a single core has been found to reduce manufacturing costs.

Figure 4:
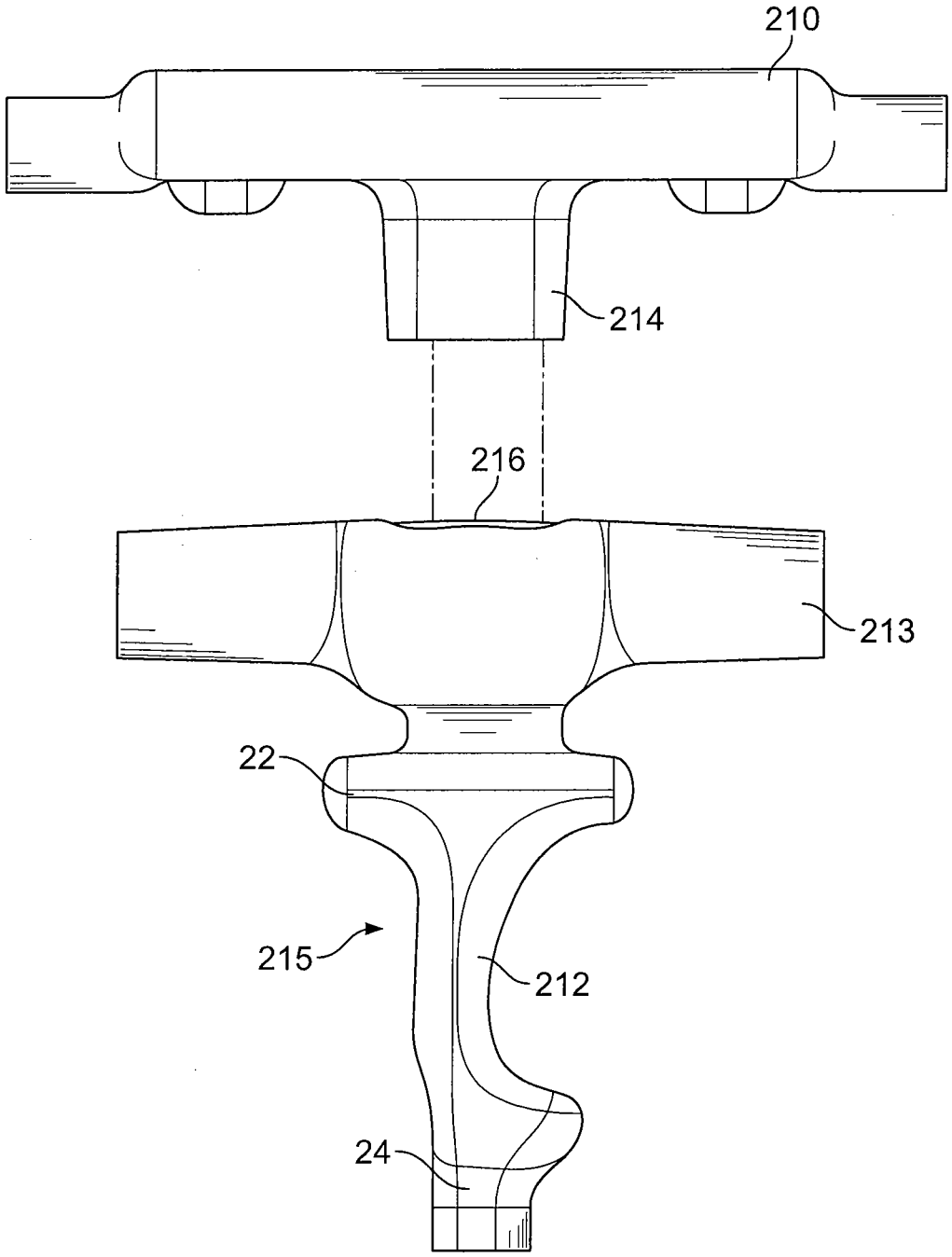
FIG. 4 is a side view of a finger core and a combined kidney and pivot pin core.

For example, and as shown in FIG. 4 the pivot core 213 and kidney core 212 have been combined into a fist core 215. Accordingly, the fist core 215 may then be joined to a finger core 210, such that two as opposed to three parts need only be joined prior to being disposed within a mold. In this exemplary embodiment, the finger core 210 is about to be connected to the fist core 215 through the interaction of an extension 214 on the finger core 210 and an opening 216 on the pivot pin core 213.

The external pulling face core 211 includes a pulling face mold portion 221 that allows for the development of the pulling face portion 58 of the knuckle without any parting line running through the pulling face. The external core repositions the parting line at the pulling face from a center section 59 of the pulling face portion, which is a high-stress area, to lower-stress areas, which is about at least 2 inches in a vertical direction 64 (FIG. 6) above and below the center section 59, and can be closer to the outer portions 60, 62 in a vertical direction 64 of the knuckle if a full-height external core (i.e., an external core that is the full height of the casting) is used.

Figure 5:
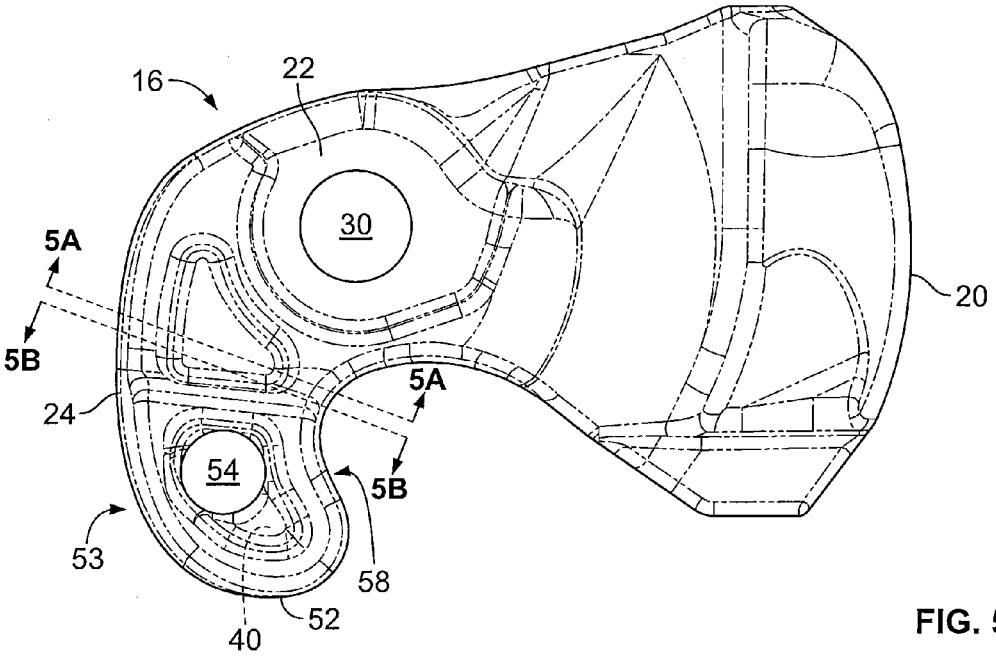
FIG. 5 is a top view of a cast coupler knuckle.
Figure 6:
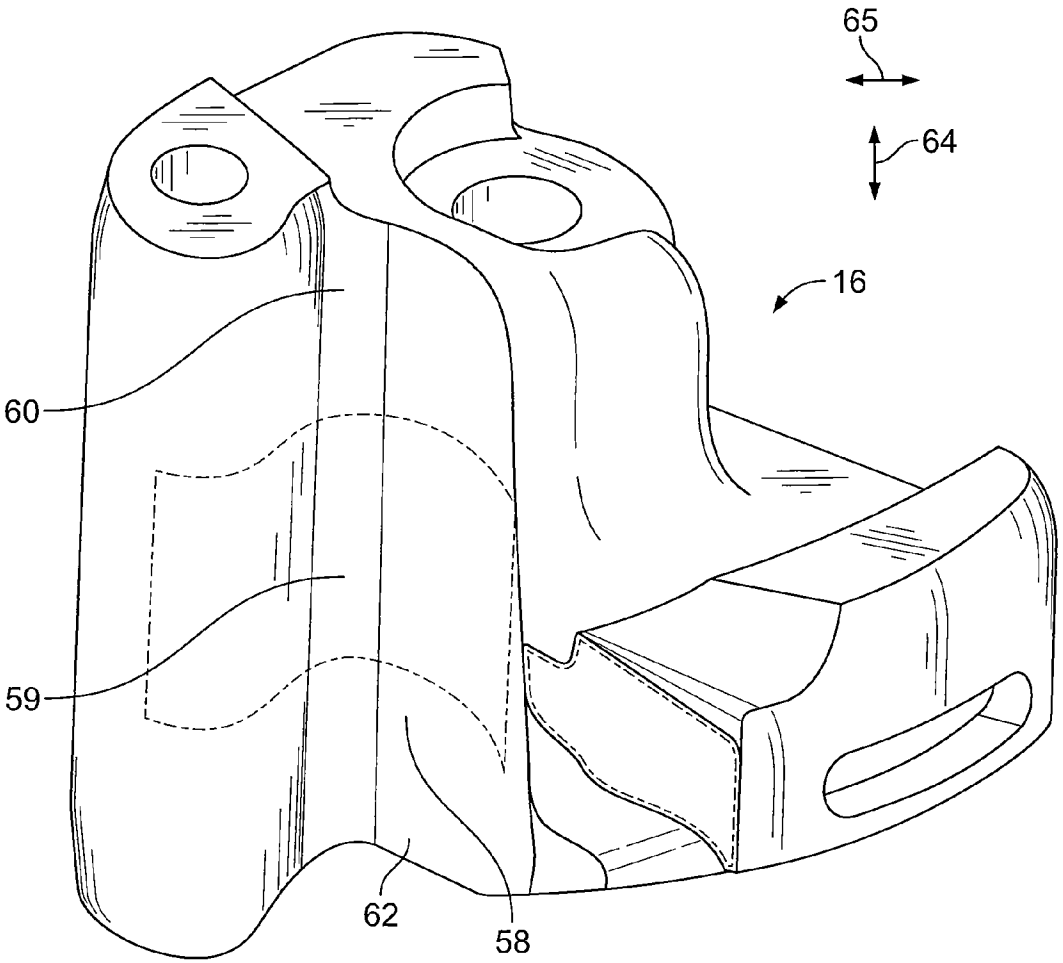
FIG. 6 is a perspective view of a cast coupler knuckle.

Once cast, and as shown in FIGS. 5-6, the coupler knuckle 16 includes a tail section 20, a hub section 22 and a front face section 24. The front face section 24 includes a nose section 52. The pulling face portion 58, with center section 59, is disposed inwardly from nose section. At least the center section 59 of the pulling face portion 58 is substantially flat in a vertical direction as defined by arrow 64 in FIG. 6.

Figure 7:
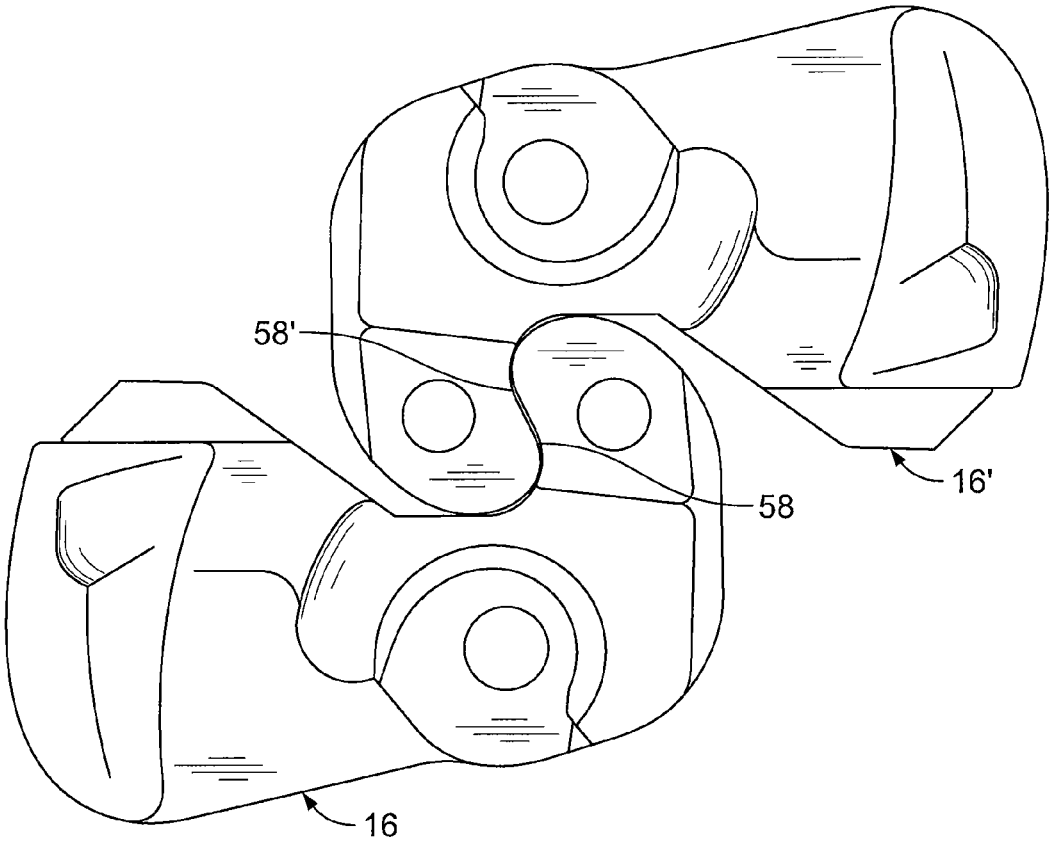
FIG. 7 shows a pair of coupler knuckles in engagement.

As shown in FIG. 7, the pulling face portion 58 and in particular the central section 59 of the coupler knuckle, acts to bear against a similar surface 58' of a coupler knuckle 16' of an adjacent railcar to couple the railcars together. Preferably the central section 59 extends in the range of about 3.5 and 7 inches in vertical direction 64 and about between 4.0 and 5.5 inches in horizontal direction 65. Moreover, and as recognized by those skilled in the art, the term "substantially flat" when used to describe the central section 59 does not require a perfectly flat surface. Rather, referring to FIG. 5B, inclined portions 57 of the substantially flat surface are inclined at an acute angle θ, which typically is in the range of about 0.5 to 1.5 degrees, relative to a line extending in vertical direction 64 to facilitate the removal of the coupler mold (cope or drag) from the pattern.

Optionally, a central 53 of the nose section 52 may include a cylindrical flag hole 54 opening, which may be formed by pins positioned within the cope and drag sections 110, 150 of the mold.

Figure 5A:
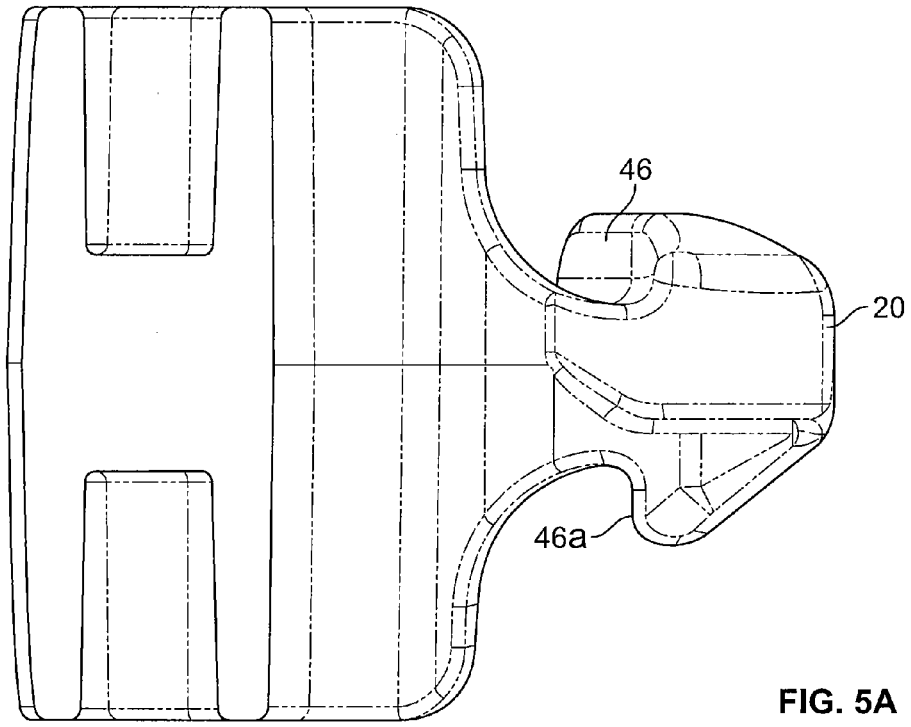
FIG. 5A is the cross-section view along line A-A of the coupler knuckle of FIG. 5.
Figure 5B:
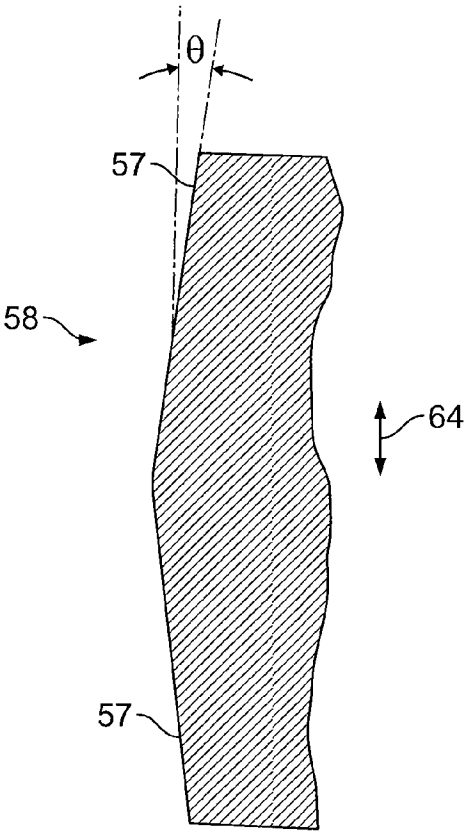
FIG. 5B is the cross-section view along line B-B of the coupler knuckle of FIG. 5.

The hub section 22 includes a pivot pin hole 30 formed therein for receiving a pivot pin to pivotally couple the knuckle 16 to a coupler for coupling to a railcar. The pivot pin hole 30 is formed from at least a portion of the single internal core 10, 12. The pivot pin hole 30 includes generally cylindrical sidewalls. The tail section 20 of the knuckle 16 also includes a top pulling lug 46 and a bottom pulling lug 46*a* used to pull the knuckle 16 when attached to the train (FIG. 5A).

A method for manufacturing the railcar coupler set forth in the afore-identified embodiments is now described. Cope and drag mold portions are provided, with each including internal walls, formed of sand using a pattern or otherwise, that define at least in part perimeter boundaries of a coupler knuckle mold cavity. As noted above, the external core is utilized to form the pulling face 58 of the knuckle coupler. Together, the mold cavity and external core correspond to the desired shape and configuration of the outer surface of a coupler knuckle to be cast.

At least one internal core is positioned within either the cope mold portion or the drag mold portion. As noted, there may be one or more cores. For example, a single core may be configured to define kidney, pivot pin, and finger core portions, such that only one core need be disposed within the mold. Alternatively, there may be a first internal core configured to define a kidney cavity and a pivot pin cavity and a second core configured to define a finger cavity, such that two cores must be joined and disposed within the mold. By way of another example, and as has been described above, the second core may be eliminated and instead the mold cavity can be configured to include at a finger section that forms at least one finger cavity of the coupler knuckle. The external core also is positioned within either the drag or cope mold portion in order to form the pulling face portion 58 of the coupler knuckle. Together, the mold cavity and external core correspond to the desired shape and configuration of the outer surface of a coupler knuckle to be cast.

The cope and drag mold portions are closed with the internal core(s) and external core there between. A molten metal or alloy is then introduced, through known methods, which solidifies to form the coupler knuckle. The presence of the one or more internal cores and/or the finger section in the mold cavity will define the kidney, pivot pin, and finger cavities of the coupler knuckle. The presence of the external core will define the pulling face of the coupler knuckle as described above.

Figure 8:
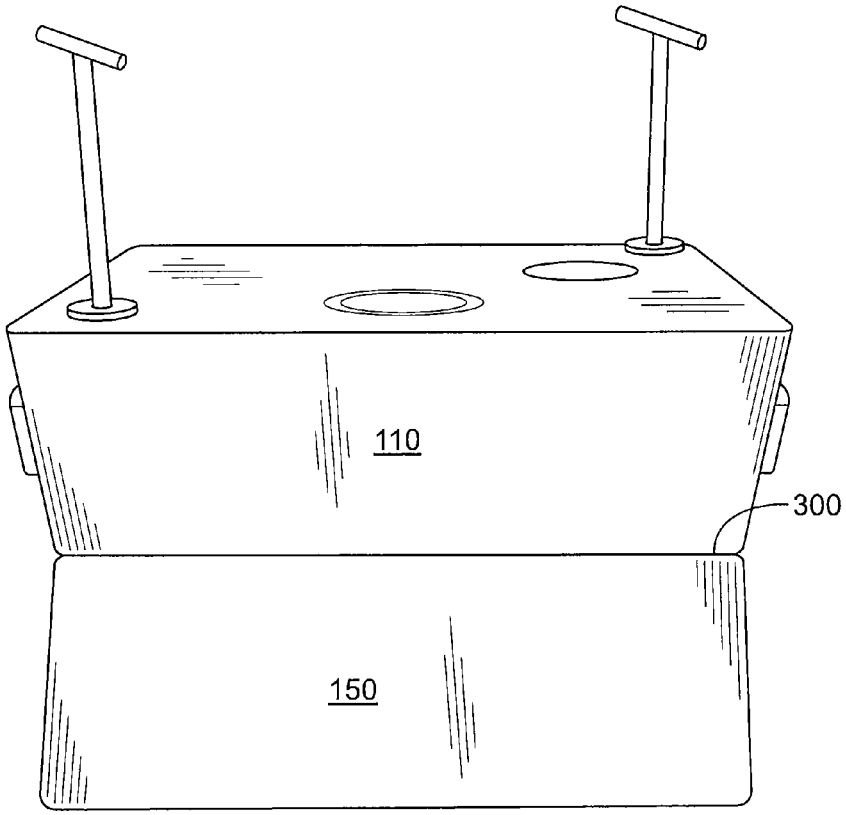
FIG. 8 shows a cope mold portion lowered onto a drag mold portion.

Referring to FIG. 8, normally, when the cope and drag mold portions 110, 150 are closed, a parting line or joint mark 300 is formed between them, which will form on the exterior surface of the coupler knuckle. However, and assuming in this embodiment that the external core is to be placed within the drag portion cavity, the presence of the external core will prevent the parting line joint from forming on the central section of the pulling face portion and instead cause it to form at the ends of the external core. Preferably, the outer ends of the core will be at least 2 inches out of range of the center section of the pulling face portion, and more preferably will be located at the outer, lower stressed portions of the knuckle and by the upper and lower portions 302, 304 of the external core (FIG. 2). Advantageously, this will prevent the parting line joint from forming on the central section 59 of the pulling face portion 58. This is desirable because the formation of parting line joints typically require the casting to undergo a grinding process in order to remove them. Grinding can affect the knuckle's surface finish and ultimately cause fatigue failures and shorten the service life of the knuckle. Moreover, due to the contact stresses the central portion of the pulling face portion experiences when it engages with another knuckle, the central portion is more susceptible to such failures. Exposing the central portion to a grinding finish generally will increase the change of such failures. Moreover, due to its location and its arcuate geometry, the central section of the pulling face is very difficult, and sometimes not even possible, to grind practically or cost-effectively. Accordingly, moving the parting line away from the central portion of the pulling face eliminates the need for subjecting the central portion to such finishing operations.

Moreover, as contemplated by the presently-described embodiments, at least a portion of the internal core and/or external core is made from a high-density sand. Suitable sands include chromite (iron magnesium chromium oxide $(Fe, Mg)Cr_2O)$) or zircon (zirconium silicate $(ZrSiO_4)$) and associated derivatives. The use of a high-density sand such as chromite or zircon, or respective chromite or zircon based derivatives, to form at least a portion of a core provides an improved knuckle casting surface finish because such sands have a finer particle size and a lower thermal expansion rate than prior art sands of silica or silica-based derivatives sands that typically are used to create the mold and/or cores. Specifically, the use of a high-density sand reduces problems associated with "shrinkage" or "micro-shrinkage." Micro-shrinkage occurs when a molten metal that is introduced into a mold during casting shrinks as it cools and solidifies. The properties of the high-density sands used in the present embodiments allow them to quickly diffuse heat and "chill" the corresponding portion of the casting at a more rapid rate such that shrinkage is minimized and sometimes even avoided. Beneficially, this results in a casting having an improved surface finish and reduces the likelihood of the formation of shrinkage defects in the knuckle, which can include fins, ripples, scars, and even a void in certain portions of the casting. Likewise, the lower thermal expansion rate of high-density sands reduces the potential for the core to contain buckles and cracks, thus reducing the potential formation of veins on the casting. The presence of such imperfections can cause the coupler knuckle to prematurely wear or fatigue. Furthermore, the reduction of the presence of such imperfections reduces the need for surface finish grinding, which can subject the knuckle to further fatigue failures as described above. Accordingly, and in particular, it is desirable to form the pulling face mold portion of the external core from a high-density sand in order to avoid the need for subjecting the pulling face portion of the knuckle to casting. As described above, this surface does not lend itself well to such finishing.

The use of high-density sands to form the internal and external cores corresponding to the portion of the casting containing the parting line joint may also reduce the need for the casting to undergo parting line joint grinding, which, as described above, has been shown to adversely affect the performance of the coupler knuckle Notably, it is preferable to use a high-density sand core that corresponds to the portion of the casting on which the parting line joint forms in order to avoid the presence of surface defects of the type described above. As described further below, it also may be desirable to use a high-density sand core to cast the pulling face portion of the front face section.

Accordingly, such high-density sands are beneficial over silica sands or silica sand derivatives, which typically are used to cast the knuckle and as is briefly described in U.S. Pat. No. 7,337,826 entitled "Railway Car Coupler Knuckle Having Improved Bearing Surface." As described below, high-density sands provide an increased chilling effect and undergo less thermal expansion during casting, and have a finer particle size than silica sands. In turn, such benefits result in the coupler knuckle having better dimensional stability, better solidity, and a superior surface finish, which reduces the potential for fatigue failures.

Moreover, the use of a high-density sand can replace the need for the inclusion of risers in the mold in this area to "feed" the volumes of the casting that are prone to shrinkage with additional casting material. Once a casting is complete, however, any excess material must be removed by surface grinding. The presence of risers and/or ingates also limits the ability to cast a knuckle having a precise profile and/or contour at its connection point. Such disadvantages subject the casting to fatigue failures as described above.

Moreover, in addition to the reasons described above, it is not practical to include risers on some areas of the casting. The pulling-face portion is one such area. The arcuate shape of the pulling face portion in the horizontal direction, as well as its susceptibility to stress failures as described above, the pulling face portion does not lend itself well to surface grinding. Moreover, as described above it is desirable for the pulling face portion to have a substantially flat surface. The inclusion of risers does not promote the formation of such a flat surface without subjecting the surface to further grinding, which again exposes the pulling-face portion to the afore-described disadvantages.

Likewise the use of high-density sands reduces the need for chills, which are used to absorb and removed heat during casting. Chills may be "external" to the casting or "internal" to the casting, with internal chills ultimately becoming part of the casting. Accordingly, because internal chills become part of the casting, care must be taken in choosing the proper chill material so that it is compatible with the casting material. Otherwise, the chill's fusion to the casting will be improper or incomplete, which may cause premature failure of the casting or require the casting to undergo further finishing and/or repairs. If external chills are not carefully placed, they may leave scars or other defects on the casting's surface that requires the casting to undergo extra finishing operations such as grinding, which may adversely affect the knuckle's surface finish. Moreover, because external chills typically are formed as small pieces of metal, they often have to be attached to an external core, which as noted above is made of silica which does not provide the benefits of high-density sand cores, so that they do not fall out of place. These must also be carefully placed so that the casting receives the benefit of the targeted area of the chill. As to both external and internal chills, they are effective only as to smaller surface areas and tend to lose their effectiveness at volumes of the knuckle further away from the chill. The use of the high-density sand core, particularly the external core, eliminates these problems because the core can be formed to be the height of the knuckle and cover any desired surface area and still not lose its effectiveness. Notably, the use of high-density sand external core(s) also eliminates the potential for surface imperfections such as those described above, eliminates problems associated with incorrectly placed chills, and the general expense associated with chills, especially internal chills because they must be made of a material compatible with the casting.

In fact, in other embodiments the external core may be made of other materials that provide the benefits discussed above. In one preferred embodiment, the external core, which functions as a "chill core," may be made from graphite. Graphite is desirable because it provides for higher cooling rates due to having high levels of thermal conductivity. Using a graphite chill core also provides the benefits discussed above as to avoiding micro-shrinkage and the use of external chills such that further surface grinding in the central section 59 upon formation of the casting may be avoided. Moreover, a graphite chill core also avoids the problems related to the requirement of careful placement of external chills as discussed above. In other embodiments, the chill core may be metallic, and preferably can be made from cast gray iron. It is desirable to select a grade of cast iron that has a larger proportion of graphite flakes since the thermal conductivity of gray iron is primarily a function of the graphite flake content. The higher the graphite flake count the higher the probability that the flakes will be touching each other, which gives gray iron a high conductivity. Another suitable example of a metallic chill core is one made from cast steel. Moreover, in other embodiments the chill core may be made from silicon carbide, which is desirable in applications involving less severe chilling requirements. Notably, the term "chill core" also may be applied to external cores that include at least portions made from zircon, chromite, their respective derivatives, as well as other high-density sands given their function of reducing micro-shrinkage. Such high-density sands are desirable because, in addition to the benefits described above, they are more readily available at foundries and are less expensive.

Figure 9:
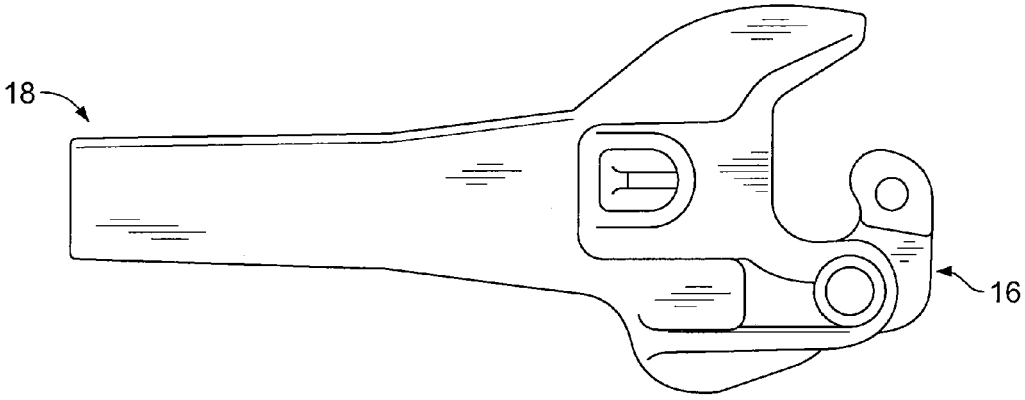
FIG. 9 shows a coupler knuckle in combination with a coupler.

The terms and descriptions used herein are set forth by way of illustration only and are not meant as limitations. Those skilled in the art will recognize that many variations can be made to the details of the above-described embodiments without departing from the underlying principles of the disclosed embodiments. For example, and referring to FIG. 9, although a coupler knuckle has been described, the above methods and systems may be used when created the coupler itself. The coupler 18 couples or connects the knuckle 16 to a railway freight car (not shown).

Furthermore, although the above-described techniques and cores have been described for use with respect to the formation of the pulling face portion, they may be used to form any portion of the knuckle (or coupler body) casting. Moreover, in one embodiment, simulation software may be used to determine where the knuckle (or coupler body) is prone to experiencing surface finishing failures and stress in order to predetermine where it may be desirable to use a high-density sand core. The simulation of such failures also may help to determine where it may be desirable to locate such cores in order to move the parting line joint that forms on the casting.

Likewise, the software may be used to predict the formation of hot spots, which again may help determine where it is desirable to use a high-density sand core. An example of suitable software is provided by Magma Foundry Technologies in Schaumburg, Ill.

Moreover, the steps of the method disclosed herein need not be executed in a certain order, unless specified, although they may have been presented in that order in the disclosure. By way of further example, the configuration of the cores described herein should not be limited to those described, as one skilled in the art would recognize such cores may be configured in various ways to produce the disclosed embodiments. Therefore, is to be understood that it is the following claims, including all equivalents, which are intended to define the spirit and scope of this invention.

The invention claimed is:

1. A method for manufacturing a railcar coupler knuckle, said method comprising:

providing a cope mold portion and a drag mold portion, the cope and drag mold portions having internal walls defining at least in part perimeter boundaries of a coupler knuckle mold cavity;

positioning at least one chill core within one of the cope mold portion and the drag mold portion;

closing the cope and drag mold portions with the at least one chill core therebetween, the closed cope and drag mold portions defining a parting line where the cope and drag mold portions contact each other;

filling the mold cavity with a molten metal, the molten metal solidifying after filling to form a steel casting including a pulling face portion such that a center section of the pulling face portion does not contain the parting line and requires no finish grinding upon its formation; and reducing micro-shrinkage within the steel casting in the pulling face portion by virtue of using the at least one chill core.

2. The method of claim 1, wherein at least a portion of the chill core further comprises a high-density casting sand comprising a sand selected from the group consisting of chromite, zircon, and a derivative thereof.

3. The method of claim 1, wherein at least a portion of the chill core comprises a sand that cools the molten metal at a rate more rapid than does sand of the cope and drag mold portions.

4. The method of claim 1, wherein the reduced micro-shrinkage occurs below the surface in the pulling face portion of the steel casting.

5. The method of claim 1, wherein the chill core is formed from graphite.

6. The method of claim 1, wherein the chill core is metallic.

7. The method of claim 6, wherein the chill core formed from cast gray iron.

8. The method of claim 1, wherein the coupler knuckle mold cavity defines a finger section that with the external core defines the pulling face portion.

9. The method of claim 1, further comprising positioning at least one internal core formed at least in part from a high-density casting sand within one of the cope mold and drag mold portions, the high-density casting sand comprising a sand selected from the group consisting of chromite, zircon, and a derivative thereof.

10. The method of claim 1, further comprising forming at least portions of the parting line at upper and lower portions of the pulling face portion.

11. The method of claim 1, wherein the at least one chill core is positioned near a pulling face portion defined by the chill core such that outer portions of the chill core are located at outer portions of the knuckle mold cavity, and wherein the parting line is pushed to the outer portions of the pulling face due to a length of the chill core along the pulling face portion.

12. A railcar coupler component, comprising:

a steel casting having a bearing surface formed at least in part by an external core positioned within a mold such that outer portions of the external core are located at outer portions of the casting along the bearing surface, the external core comprising a chill core;

a parting line formed at outer portions of the bearing surface of the casting corresponding to the outer portions of the external core, the outer portions of the bearing surface being subject to lower stresses when under load from another casting when compared with a center section of the bearing surface, wherein the parting line is not near the center section of the bearing surface and, therefore, the center section requires no grinding upon its formation; and a portion of the steel casting exhibts reduced micro-shrinkage in an area below the bearing surface when compared with a steel casting manufactured without use of the external core.

13. The railcar coupler component of claim 12, wherein the casting comprises a coupler knuckle, and wherein the bearing surface comprises a pulling face portion of the knuckle.

14. The railcar coupler component of claim 13, wherein portions of the parting line are located at upper and lower portions of the pulling face portion of the knuckle.

15. The railcar coupler component of claim 12, further comprising at least one internal core disposed within the mold to define an internal cavity of the casting, and wherein the internal core is made from a high-density casting sand such that the portion of the casting defined by the internal core made from a high-density casting sand requires no grinding upon formation of the casting, wherein the high-density casting sand comprises a sand selected from the group consisting of chromite, zircon, and a derivative thereof.

16. The railcar coupler component of claim 12 further comprising at least one internal core disposed within the mold to define an internal cavity of the casting, wherein the internal and external cores are formed from chromite and reduce micro-shrinkage in the center section of the bearing surface.

17. The railcar coupler component of claim 12, wherein the casting comprises a coupler body.

18. The railcar coupler component asscmbly of claim 12, wherein at least a portion of the external core further comprises a high-density casting sand comprising a sand selected from the group consisting of chromite, zircon, and a derivative thereof.

19. The railcar coupler component of claim 12, wherein the external core comprises a chill core having at least a portion comprising a sand that cools molten metal at a rate more rapid than does sand of the cope and drag mold portions.

20. The railcar coupler component of claim 12, wherein the external core is formed from graphite.

21. The railcar coupler component of claim 12, wherein the external core is metallic.

22. The railcar coupler component of claim 21, wherein the external core is formed from cast gray iron.

23. A railcar coupler knuckle, comprising:

a steel casting having a pulling face portion formed at least in part by an external chill core positioned within a mold such that outer portions of the external chill core are located at outer portions of the casting along the pulling face portion; and a portion of the steel casting exhibits reduced micro-shrinkage in an area below a surface of the pulling face portion when compared with a steel casting manufactured without use of the external chill core.

24. The railcar coupler knuckle of claim 23, wherein the chill core comprises a high-density casting sand comprising a sand selected from the group consisting of chromite, zircon, and a derivative thereof.

25. The coupler knuckle of claim 23, wherein the chill core is made from graphite.

26. The coupler knuckle of claim 23, wherein the chill core is metallic.

27. The coupler knuckle of claim 23, wherein the chill core is made from cast gray iron.

28. The coupler knuckle of claim 23, further comprising at least one internal core to define a cavity of the casting, and wherein at least a portion of the internal core includes a chill core portion formed of chromite.

29. The coupler knuckle of claim 23, wherein the portion of the steel casting containing the reduced micro-shrinkage comprises a center section of the pulling face portion.

30. The coupler knuckle of claim 23, wherein at least a portion of the external chill core comprises a sand that cools motel metal at a rate more rapid than does sand of the cope and drag mold portions.

* * * * *